United States Patent [19]

Nakazawa et al.

[11] 4,269,256

[45] May 26, 1981

[54] PROCESS FOR PREPARING MOLD

[75] Inventors: Tetsuo Nakazawa, Shimoinayoshi; Junji Sakai, Minorimachi; Syogo Morimoto, Matsudo, all of Japan

[73] Assignee: Hitachi, Ltd., Tokyo, Japan

[21] Appl. No.: 76,229

[22] Filed: Sep. 17, 1979

Related U.S. Application Data

[63] Continuation-in-part of Ser. No. 893,013, Apr. 3, 1978, abandoned.

[30] Foreign Application Priority Data

Apr. 4, 1977 [JP] Japan ..... 52-37621
Apr. 4, 1977 [JP] Japan ..... 52-37622

[51] Int. Cl.[3] ..... B22C 1/22; B22C 9/12

[52] U.S. Cl. ..... 164/16; 106/38.2; 164/43; 260/42.11; 260/42.13

[58] Field of Search ..... 106/38.2; 260/42.11, 260/DIG. 40, 42.13; 164/43, 12, 16

[56] References Cited

U.S. PATENT DOCUMENTS

| | | | |
|---|---|---|---|
| 2,609,350 | 9/1952 | Spatt | 260/29.6 WB |
| 2,765,507 | 10/1956 | Wolf et al. | 164/43 |
| 2,817,128 | 12/1957 | Wickett | 164/43 |
| 2,999,830 | 9/1961 | Gruber et al. | 260/DIG. 40 |
| 3,003,988 | 10/1961 | Germann et al. | 106/35 |
| 3,243,398 | 3/1966 | Bonzagni | 260/29.6 WB |
| 3,298,987 | 1/1967 | Colgan et al. | 260/42.51 |
| 3,365,408 | 1/1968 | Ohara | 260/29.6 WB |
| 3,501,424 | 3/1970 | Imoto et al. | 260/17 R |
| 3,714,086 | 1/1973 | Schaefer et al. | 260/29.6 WA |
| 3,915,919 | 10/1975 | Nishioka et al. | 260/29.6 BM |
| 4,162,238 | 7/1979 | Bergna | 164/43 X |
| 4,163,000 | 7/1979 | Kashima et al. | 164/43 X |

FOREIGN PATENT DOCUMENTS

| | | | |
|---|---|---|---|
| 42-25527 | 12/1967 | Japan | 164/43 |
| 432964 | 11/1974 | U.S.S.R. | 260/42.13 |

*Primary Examiner*—Robert D. Baldwin
*Assistant Examiner*—J. Reed Batten, Jr.
*Attorney, Agent, or Firm*—Craig and Antonelli

[57] ABSTRACT

A mold with an increased compression strength and a good collapsibility is prepared with a good efficiency by mixing refractory particles with a binder material comprising a caustic alkali-neutralized product of a copolymer containing a carboxyl group and calcium hydroxide, thereby preparing molding materials, filling the molding materials around a pattern, and blowing $CO_2$ gas into the mold sand, thereby hardening the molding materials. Polyvinyl alcohol, calcium oxide, at least one hydroxide of zinc, aluminum, barium, magnesium, and iron, SBR latex, etc. can be added to the binder material, when desired.

8 Claims, 2 Drawing Figures

PROCESS FOR PREPARING MOLD

This is a continuation-in-part application of Ser. No. 893013 filed on Apr. 3, 1978 and now abandoned.

The present invention relates to a process for preparing a mold which is hardened by $CO_2$ gas.

In practical molds for molding metals, there have heretofore been used inorganic binder materials such as sodium silicate and organic binder materials such as phenol resins and furan resins. All the molds using these binder materials have properties which can endure pressure or heat of molten metals. However, the molds using inorganic binder materials have a weak point in the operation that it is very difficult to remove castings and it takes a lot of time to produce the castings owing to the poor collapsibility of molds after pouring. Also, the molds using organic binder materials have not such a weak point. As a method for hardening a mold, there are self-hardening process by chemical reaction of the binder material components in the molding materials and cold setting process which comprises hardening a mold by blowing $CO_2$ gas or an amine gas into the molding materials after molding materials containing binder materials has been filled around pattern. The former hardening method is limited in the time during which molding materials can be effectively used, that is, bench life since chemical reaction starts simultaneously with the addition of the binder materials to molding materials. As the latter hardening method, there are so-called $CO_2$ process which comprises blowing $CO_2$ gas into molding materials containing, for example, sodium silicate as a binder material to effect hardening, a method which comprises blowing an amine gas into molding materials containing a hydroxyl group-containing resin (for example, a phenol resin) and a polyisocyanate as a binder material to effect hardening, and a method which comprises blowing $CO_2$ gas into molding materials containing a combination of an acrylic copolymer or a phenol resin and calcium hydroxide as binder materials to effect hardening. These methods can give a good mold production efficiency since the bench life of molding materials is longer than by the former hardening method by the chemical reaction of the binder material components contained in molding materials and the molding materials begin to harden as soon as the gas is blown into the molding materials. However, the $CO_2$ process has a weak point in the mold collapsibility. Also, in the method using an amine gas the toxicity and bad odor of amine gases give rise to trouble. Further, the method using a combination of a copolymer of an acrylic acid ester, ammonium acrylate and sodium acrylate, calcium hydroxide and $CO_2$ gas has the following defects:

(1) The ammonia gas is let loose by the preparation of molding materials and it pollutes working environment.

(2) The strength of a mold immediately after blowing $CO_2$ gas is unsatisfactory. Further, the method using a phenol resin does not cause the pollution of working environment by the release of ammonia gas, but an increase in the strength of a mold is small since the hardening of molding materials after blowing $CO_2$ gas is carried out only by drying.

The present inventors previously proposed, as a technique for solving the above-mentioned problems in the $CO_2$ process and the other prior art processes for producing a mold, a process for producing a mold by using a combination of polyvinyl alcohol, calcium hydroxide or calcium oxide and $CO_2$ gas. This process greatly improved prior art, but when a large mold is produced, it was difficult to harden molding materials uniformly to its inside.

Therefore, an object of the present invention is to provide a process for preparing a mold by hardening molding materials by $CO_2$ gas, wherein the advantages of prior art have been retained, whereas the above-mentioned defects of the prior art have been obviated, and more specifically the object of this invention is to provide a process for preparing a mold having a high compressive strength and good collapsibility at a good mold production efficiency.

The other objects and advantages of the present invention will be apparent from the following description.

The present invention provides a process for preparing a mold by hardening molding materials by $CO_2$ gas, which comprises mixing refractory particles with a binder material comprising a caustic alkali-neutralized product of at least one copolymer selected from the group consisting of $\alpha$-olefin-maleic anhydride copolymer, styrene-maleic anhydride copolymer, and methyl vinyl ether-maleic anhydride copolymer, and calcium hydroxide, thereby preparing molding materials, filling the molding materials around a pattern, and blowing $CO_2$ gas into the molding materials, thereby hardening the molding materials, where 0.2–2.0 parts by weight of the copolymer and 0.2–4.0 parts by weight of the calcium hydroxide are added to 100 parts by weight of the refractory particles, and polyvinyl alcohol, calcium oxide, at least one hydroxide of zinc, aluminum, barium, magnesium and iron, and SBR (styrene-butadiene rubber) latex can be added thereto, when desired.

The present invention will be described, referring to the drawings.

Figure 1:
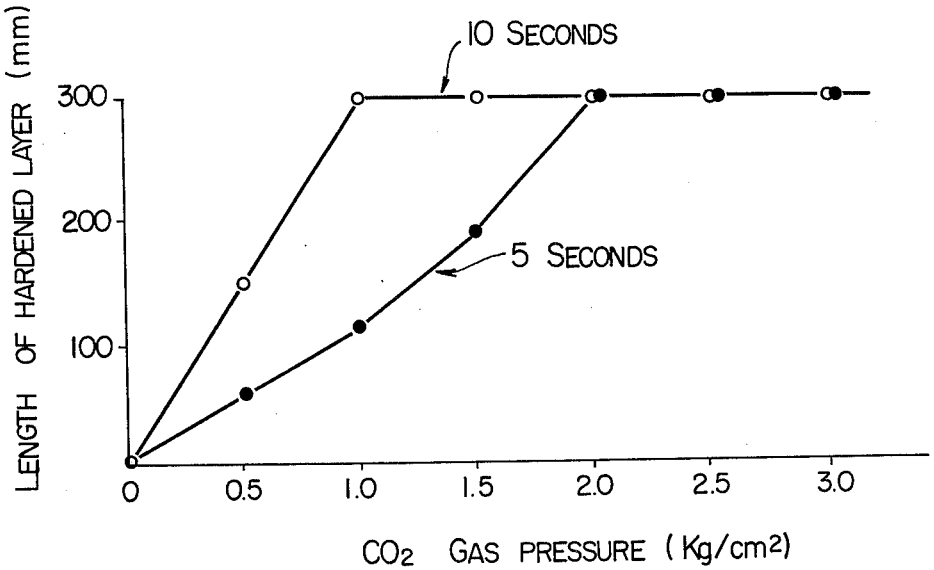
FIG. 1 is a diagram showing relation between $CO_2$ gas pressure and length of hardened layer according to one embodiment of the present invention.

The process for preparing a mold according to the present invention has both the advantages of the $CO_2$ process and the advantages of molds using organic binder materials.

The respective components of the binder material will be explained below.

First of all, the carboxyl group-containing polymers which may be used in the present invention are as follows:

(1) Homopolymers of a monomer containing a functional group convertible into carboxyl group by hydrolysis or alkali saponification such as maleic anhydride, citraconic anhydride, itaconic anhydride, acrylic acid esters, methacrylic acid esters, crotonic acid esters, maleic acid diesters and fumaric acid diesters and binary or ternary copolymers of these monomers with an unsaturated monomer copolymerizable with these monomers.

(2) Polymers obtained by incorporating carboxyl group into a polymer containing a reactive functional group in its side chain by etherification, esterification or acetalization such as oxalic acid-esterified polyvinyl alcohol, glycolic acid-etherified polyvinyl alcohol, glyoxalic acid-acetalized polyvinyl alcohol and carboxymethyl cellulose.

Among these carboxyl group-containing polymers are preferred styrene-maleic anhydride copolymers, methyl vinyl ether-maleic anhydride copolymers and α-olefin-maleic anhydride copolymers. When these carboxyl group-containing polymers are readily soluble in water, only water may be used as a solvent. The polymers sparingly soluble or insoluble in water are dissolved in water containing a caustic alkali to prepare an alkali-neutralized product thereof, and then used.

The polyvalent metal oxides and hydroxides which may be used in the present invention include oxides and hydroxides of calcium, magnesium, barium, zinc, aluminum and iron. Also, bentonite, clay and talc comprising these oxides or hydroxides and "satin white" which is a complex mixture of aluminum sulfate and calcium hydroxide may be used. Among these oxides or hydroxides are particularly preferable those of calcium, magnesium and barium. Calcium hydroxide can be used alone as the metal oxides and hydroxides, and the other metal oxides and hydroxides can be effectively used in the form of a mixture of at least two oxides or hydroxides containing calcium hydroxide.

Among these binder material components, 0.2–2.0 parts by weight of the copolymer as solid matters are added to 100 parts by weight of the refractory particles. A statisfactory mold strength cannot be obtained below 0.2 parts by weight of the copolymer, whereas gas generation from a mold is unpreferably increased at pouring of molten metal above 2.0 parts by weight of the copolymer.

0.2–4.0 Parts by weight of calcium hydroxide are added to 100 parts by weight of the refractory particles. A satisfactory strength right after the start of hardening by $CO_2$ gas cannot be obtained below 0.2 part by weight of the calcium hydroxide, whereas a proportion of fine powder is increased above 4.0 parts by weight of the calcium hydroxide, lowering the ultimate strength.

The polyvinyl alcohol resins which may be used in the present invention include partially saponified polyvinyl alcohol, completely saponified polyvinyl alcohol, acrylamide group-containing polyvinyl alcohol and acrylic acid group-containing polyvinyl alcohol. These polyvinyl alcohol resins must be added in an amount of not more than 2 parts by weight per 100 parts by weight of the refractory particles. If the amount of the polyvinyl alcohol resin added is more than 2 parts by weight, the viscosity of the binder material remarkably increases and it is not preferable from a viewpoint of operation.

Wood flour or various emulsions and latices may be added to a binder material to improve its adhesive force or control its viscosity according to the amount added.

The binder material can be packed in any one of the following forms (A), (B) and (C):

(A) The first component: an aqueous solution of a carboxyl group-containing polymer, the second component: a metal oxide or metal hydroxide, the third component: an aqueous solution of a polyvinyl alcohol resin.

(B) The first component: a suspension of a metal oxide or metal hydroxide in an aqueous solution of a carboxyl group-containing polymer, the second component: an aqueous solution of a polyvinyl alcohol resin.

(C) The first component: a mixture of an aqueous solution of a carboxyl group-containing polymer, a metal oxide or metal hydroxide, and an aqueous solution of a polyvinyl alcohol resin.

In the case of the (A) type of the binder material thus packed, the three components are respectively added to refractory particles. Similarly, in the case of the (B) type of the binder material, the two components are respectively added to refractory particles; and in the case of the (C) type of the binder material, the one component is added to refractory particles. In this manner, molding materials are obtained. When the molding materials are filled around a pattern and $CO_2$ gas is blown thereinto, the molding materials are immediately hardened to form a mold for casting. In this case, if the pattern is kept sealed without blowing $CO_2$ gas thereinto, the molding materials are not hardened but can be stored for a long period of time.

When styrene-maleic anhydride copolymers, methyl vinyl ether-maleic anhydride copolymers and α-olefin-maleic anhydride copolymers among the above-mentioned polymers are dissolved in water, the addition of a caustic alkali is required. By the addition of a caustic alkali, an alkali metal such as Na or K is combined with the carboxyl group of the polymers and as a result, the polymers are water-solubilized. As for the term "styrene-maleic anhydride copolymers, methyl vinyl ether-maleic anhydride copolymers and α-olefin-maleic anhydride copolymers" used herein, for example, the term "α-olefin-maleic anhydride copolymers" means not only copolymers of an α-olefin and maleic anhydride but also copolymers containing the other components in addition to these two essential components, for example, ternary copolymers of an α-olefin, maleic anhydride and a maleic acid diester. Also, the term "α-olefin-maleic acid monoester copolymers" means not only copolymers of an α-olefin and a maleic acid monoester but also copolymers containing the other components in addition to these two essential components, for example, ternary copolymers of an α-olefin, a maleic acid monoester and a maleic acid diester. The α-olefins may be straight-chain or branched-chain ones having 2 to 8, and preferably 2 to 6 carbon atoms. Specific examples thereof include ethylene, propylene, n-butene, isobutylene, n-pentene, isoprene and 2-methyl-1-butene.

When polyvinyl alcohol is not employed, binder material is packed in either of the following two forms (D) and (E):

(D) The first component: an alkali-neutralized aqueous solution of a polymer; the second component: a metal oxide or metal hydroxide.

(E) The first component: a suspension of a metal oxide or metal hydroxide in an alkali-neutralized aqueous solution of a polymer.

In the case of the (D) type of the binder material thus packed, the two components are respectively added to refractory particles. Similarly, in the case of the (E) type of the binder material, the one component is added to refractory particles. In this manner, molding materials are obtained. When the molding materials are filled around a pattern and $CO_2$ gas is blown thereinto, the molding materials are immediately hardened to form a mold for casting. In this case, if the pattern is kept sealed without blowing $CO_2$ gas thereinto, the molding materials are not hardened but can be stored for a long period of time.

As explained above, according to the present invention, the following effects are obtained:

(1) A mold production efficiency can be improved since molding materials are rapidly hardened.

(2) The compressive strength of the resulting mold is high.

(3) The collapsibility of the resulting mold is good. Further, the following effects are obtained.

(4) Working environment is good since any poisonous gas or any bad odor is not released on molding.

(5) Molding materials can be easily prepared.

(6) The bench life of the resulting molding materials is long.

(7) The amount of $CO_2$ gas used is small.

The following examples illustrate the present invention in more detail.

EXAMPLE 1

25 Grams of a copolymer of isobutylene and meleic anhydride, 13 g of caustic soda and 60 g of water were mixed. The resulting mixture was heated at 65° C. to form a solution. To the solution were added successively 30 g of calcium hydroxide and 60 g of water. The resulting mixture was stirred to form a white suspension. To the white suspension was added and mixed 10 g of an aqueous solution of partially saponified polyvinyl alcohol having a concentration of 25% by weight to form a binding agent composition.

To 1 kg of JIS No. 100 silica sand* was added and mixed 40 g of the thus prepared binder material composition. The resulting mixture was rammed into a cylindrical test bar having a diameter of 50 mm and a length of 50 mm and $CO_2$ gas was passed therethrough at a pressure of 1 kg/cm$^2$ for 5 seconds. Thus, a change in the strength of the test bar with the lapse of time from the preparation of the test bar was examined. Also, as a comparative example, 30 g of a copolymer of methyl acrylate and ammonium acrylate as a binder material, 20 g of water and 20 g of calcium hydroxide were added to and mixed with 1 kg of the same silica sand, and a similar test as described above was carried out.

Note*: A particle size of silica sand as standardized in Japanese Industrial Standard (JIS) which has a peak at 100 mesh.

The results obtained are shown in Table 1.

TABLE 1

| | Compressive strength (kg/cm$^2$) | | | | | |
|---|---|---|---|---|---|---|
| After molding (hr) | 0 | 1 | 2 | 3 | 4 | 24 |
| Test bar 1 (the present invention) | 3.7 | 5 | 9 | 12 | 16 | 37 |
| Test bar 2 (comparative ex.) | 1.5 | 2.6 | 3.5 | 4.6 | 4.8 | 16 |

In the test bar of the present invention, strength immediately after molding was higher, an increase in strength with time was larger, and strength after 24 hours was higher. Also, working environment was good. On the other hand, in the test bar of the comparative example, there was a problem of working environment in that ammonia odor was generated on preparation of molding materials or on molding. Also, the strength of the test bar was lower.

EXAMPLE 2

25 Grams of a copolymer of styrene and maleic anhydride, 8 g of caustic soda and 70 g of water were mixed. The resulting mixture was heated at 65° C. to form a solution. To the solution were added successively 30 g of calcium hydroxide and 60 g of water to form a white suspension. To the white suspension was added and mixed 10 g of an aqueous solution of partially saponified polyvinyl alcohol having a concentration of 25% by weight to form a binder material composition. The binder material composition was tested in the same manner as in Example 1. As a result, its compressive strengths immediately after molding and after 24 hours were found to be 3.5 kg/cm$^2$ and 32 kg/cm$^2$, respectively.

EXAMPLE 3

25 Grams of a copolymer of styrene and maleic anhydride, 8 g of caustic soda and 70 g of water were mixed. The resulting mixture was heated at 65° C. to form a solution. To the solution were added successively 20 g of aluminum hydroxide, 20 g of calcium hydroxide and 60 g of water. The resulting mixture was stirred to form a suspension. To the suspension was added and mixed 10 g of an aqueous solution of partially saponified polyvinyl alcohol having a concentration of 25% by weight to form a binder material composition. The binder material composition was tested in the same manner as in Example 1. As a result, its compressive strengths immediately after molding and after 24 hours were found to be 3.7 kg/cm$^2$ and 38 kg/cm$^2$, respectively.

EXAMPLE 4

30 Grams of a copolymer of isobutylene and maleic anhydride, 20 g of caustic soda and 150 g of water were mixed. The resulting mixture was heated at 65° C. to form a solution. To 1 kg of JIS No. 100 silica sand were respectively added and mixed 40 g of the solution, 10 g of an aqueous solution of partially saponified polyvinyl alcohol having a concentration of 20% by weight, and 20 g of calcium hydroxide. A cylindrical test bar having a diameter of 50 mm and a length of 50 mm was prepared by the use of the resulting mixture and was then tested in the same manner as in Example 1. As a result, its compressive strengths immediately after molding (immediately after blowing $CO_2$ gas) and after 24 hours were found to be 4.2 kg/cm$^2$ and 43 kg/cm$^2$, respectively.

EXAMPLE 5

Mold hardening characteristics were examined with regard to the binder material composition according to the present invention as prepared in Example 1 and a binder material composition consisting of a 20% by weight aqueous solution of polyvinyl alcohol and calcium hydroxide. The blending ratio of the molding materials and the test results obtained are shown in Table 2. The test bar formed was in the form of a cylinder having a diameter of 25 mm and a length of 300 mm. Each molding material was charged into a mold and $CO_2$ gas was then blown thereinto from one end of the mold at a pressure of 1 kg/cm$^2$ for 10 seconds. The length of a hardened layer was measured.

TABLE 2

| | Item | | |
|---|---|---|---|
| Binder material | Blending ratio | | Length of hardened layer (mm) |
| According to the present invention | JIS No. 65 silica sand | 1 kg | 300 (All uniformly hardened) |
| | Binder material of Example 1 | 40 g | |
| Consisting of polyvinyl alcohol and calcium hydroxide (comparative example) | JIS No. 65 silica sand | 1 kg | 185 (About half hardened) |
| | 20% by weight aqueous polyvinyl alcohol solution | 40 g | |
| | Calcium hydroxide | 20 g | |

The binder material according to the present invention showed good reactivity with $CO_2$ gas and thereby gave a rapid hardening velocity and a good mold production efficiency. Further, it was economical in that the molding materials could be hardened with a small amount of $CO_2$ gas.

EXAMPLE 6

A mold was produced by using the same binder material and blending ratio in molding materials as used in Example 1, and a housing for a motor weighing 18 kg was cast by the use of the resulting mold. As a result, the product was free from casting defects and the collapsibility of the core portion was good.

EXAMPLE 7

120 Grams of a 1:1 (by mole) copolymer of isobutylene and maleic anhydride, 50 g of caustic soda and 180 g of water were mixed. The resulting mixture was heated at 90° C. to form a solution. To the solution were added successively 300 g of calcium hydroxide and 500 g of water. The resulting mixture was stirred to form a white suspension. To the white suspension was added and mixed 360 g of a latex (solid content 50% by weight) of a copolymer of styrene and butadiene to obtain a mold binding material. To 1 kg of JIS No. 100 silica sand was added 40 g of the binder material. The resulting mixture was rammed into a cylindrical test bar having a diameter of 50 mm and a length of 50 mm and $CO_2$ gas was passed therethrough at a pressure of 1 kg/cm$^2$ for 5 seconds. An increase in strength with time from the preparation of the test bar was examined. Also, as a comparative example, 30 g of a copolymer of methyl acrylate and ammonium acrylate as a binder material, 20 g of water and 20 g of calcium hydroxide were added to the same silica sand. The resulting mixture was tested in the same manner as described above. The results obtained are shown in Table 3.

TABLE 3

| | Compressive strength (kg/cm$^2$) | | | | | |
|---|---|---|---|---|---|---|
| After molding (hr) | 0 | 1 | 2 | 3 | 5 | 24 |
| Test bar (the present invention) | 4 | 8 | 13 | 18 | 23 | 40 |
| Test bar 2 (comparative ex.) | 1.5 | 2.6 | 3.5 | 4.6 | 5.0 | 16 |

In the test bar of the present invention, strength immediately after molding was higher, an increase in strength with the lapse of time was larger, and strength after 24 hours was higher.

EXAMPLE 8

120 Grams of a copolymer of styrene and maleic anhydride, 50 g of caustic soda and 180 g of water were mixed. The resulting mixture was heated to form a solution. To the solution were added successively 300 g of calcium hydroxide and 500 g of water. The resulting mixture was stirred to form a white suspension (which is referred to as "binder material 1").

120 Grams of a copolymer of methyl vinyl ether and maleic anhydride, 50 g of caustic soda and 180 g of water were mixed. The resulting mixture was heated to form a solution. To the solution were added successively 300 g of calcium hydroxide and 500 g of water. The resulting mixture was stirred to form a white suspension (which is referred to as "binder material 2").

A mold strength test with regard to binder materials 1 and 2 was carried out by using the same blending ratio and $CO_2$ gas treatment as in Example 1. The results obtained are shown in Table 4. As is clear from the table, a mold having a high compressive strength was obtained.

TABLE 4

| | Compressive strength (kg/cm$^2$) | |
|---|---|---|
| After molding (hr) | 0 | 24 |
| Binder material 1 | 3.2 | 25 |
| Binder material 2 | 3.6 | 30 |

EXAMPLE 9

25 Grams of a copolymer of isobutylene and maleic anhydride, 13 g of caustic soda and 62 g of water were mixed. The resulting mixture was heated at 65° C. to form a solution. To the solution were added successively 60 g of calcium hydroxide, 1.25 g of zinc hydroxide, 20 g of an SBR latex and 50 g of water. The resulting mixture was stirred to form a white suspension. A mold strength test with regard to the white suspension as a binder material was carried out by using the same blending ratio as in Example 7. As a result, the compressive strength of the mold thus produced was 3.8 kg/cm$^2$ immediately after molding and 34 kg/cm$^2$ after 24 hours.

EXAMPLE 10

A solution was prepared from a copolymer of isobutylene and maleic anhydride, caustic soda and water in the same manner as in Example 9. Without adding the other additives, an amount of the solution corresponding to that in Example 1 was added and mixed on the preparation of molding materials. Further, 10 g of calcium hydroxide alone was added. The same test as in Example 7 was carried out. The compressive strength of the mold thus produced was 3.5 kg/cm$^2$ immediately after molding and 34 kg/cm$^2$ after 24 hours.

EXAMPLE 11

Mold hardening characteristics were examined with regard to the binding agent composition according to the present invention as prepared in Example 7 and a binder material composition consisting of a 20% by weight aqueous solution of polyvinyl alcohol and calcium hydroxide. The blending ratio and the test results obtained are shown in Table 5. The test bar formed was in the form of a cylinder having a diameter of 25 mm and a length of 300 mm. Each molding material was charged into a mold and $CO_2$ gas was then blown thereinto from one end of the mold at a pressure of 1 kg/cm$^2$ for 10 seconds. The length of a hardened layer was measured.

TABLE 5

| | Item | | |
|---|---|---|---|
| Binder material | Blending ratio | | Length of hardened layer (mm) |
| According to the present invention | JIS No. 65 silica sand | 1 kg | 300 (All uniformly hardened) |
| | Binder material of Example 7 | 40 g | |
| Consisting of polyvinyl alcohol and | JIS No. 65 silica sand | 1 kg | 185 (About half |
| | 20% by weight | 40 g | |

TABLE 5-continued

| Binder material | Item: Blending ratio | | Length of hardened layer (mm) |
|---|---|---|---|
| calcium hydroxide (comparative example) | aqueous polyvinyl alcohol solution | | hardened) |
| | Calcium hydroxide | 20 g | |

The binder material according to the present invention showed good reactivity with $CO_2$ gas and thereby gave a rapid hardening speed and a good mold production efficiency. Further, it was economical in that the molding materials could be hardened with a small amount of $CO_2$ gas.

EXAMPLE 12

A mold was produced by using the same binder material and blending ratio in molding materials as used in Example 7, and a housing for a motor weighing 18 kg was cast by the use of the resulting mold. As a result, the product was free from casting defects and the collapsibility of the core portion was good.

EXAMPLE 13

A binder material consisting of 25 g of isobutylene-maleic anhydride copolymer, 13 g of caustic soda and 62 g of water was prepared, and 40 g of the resulting binder material was added to 1 kg of JIS No. 100 silica sand, and then admixed with 10 g of calcium hydroxide and subjected to further mixing to prepare molding materials. The molding materials were filled in a mold to prepare a columnar mold, 25 mm in diameter and 300 mm long, and then $CO_2$ gas was blown into the molding materials from one end of the former mold under pressures of less than 3.0 kg/cm$^2$ for 5 seconds and 10 seconds, and the length of hardened layer was measured. The results are shown in FIG. 1. It is obvious from FIG. 1 that the length of hardened layer reached 300 mm for 10 seconds under a gas pressure of 1 kg/cm$^2$, whereas it reached 300 mm for 5 seconds under a gas pressure of 2.0 kg/cm$^2$. That is, when the gas pressure is doubled, the length of hardened layer will be also doubled.

EXAMPLE 14

Figure 2:
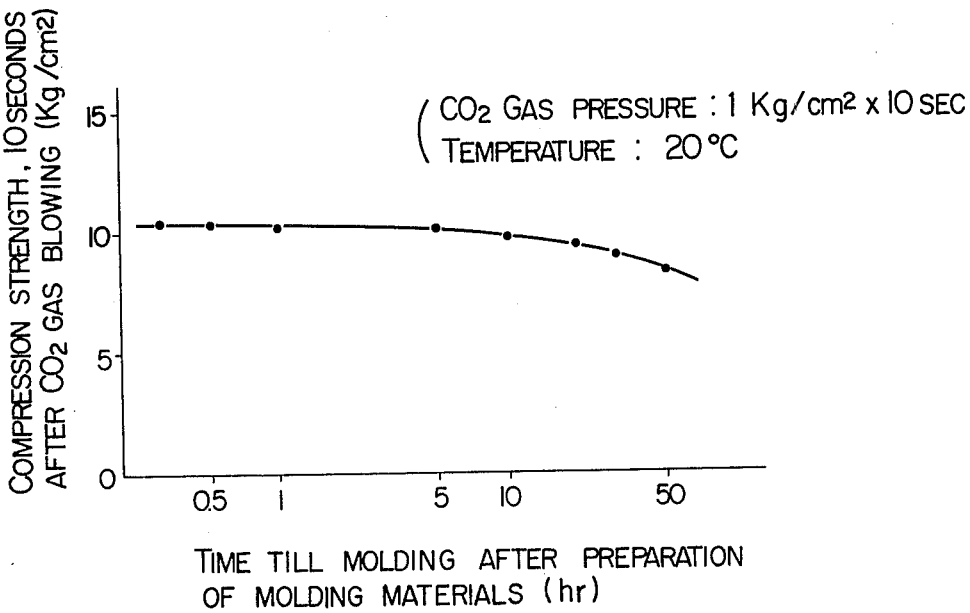
FIG. 2 is a diagram showing relations between time till molding after preparing the molding materials and compression strength, 10 seconds after $CO_2$ gas blowing into molding materials.

The molding materials prepared in Example 13 were preserved air-tightly, and after a predetermined time test pieces (50 mm in diameter and 300 mm long) were prepared, and a compression strength of the test pieces 10 seconds after the blowing of the $CO_2$ gas was measured. The results are shown in FIG. 2. It is obvious from FIG. 2 that the molding materials are satisfactorily applicable even 50 hours after the preparation, so long as they are air-tightly preserved.

What is claimed is:

1. A process for perparing a mold by hardening molding materials by $CO_2$ gas which comprises mixing refractory particles with a binder material comprising a caustic alkali-neutralized product of at least one copolymer selected from the group consisting of α-olefin-maleic anhydride copolymer, styrene-maleic anhydride copolymer, and methylvinyl ether-maleic anhydride copolymer, and calcium hydroxide, thereby preparing molding materials, filling the molding materials around a pattern, and blowing $CO_2$ gas into the molding materials, thereby hardening the molding materials.

2. A process according to claim 1, wherein 0.2–2.0 parts by weight of the copolymer as solid matters is added to 100 parts by weight of the refractory particles.

3. A process according to claim 1, wherein 0.2–4.0 parts by weight of the calcium hydroxide is added to 100 parts by weight of the refractory particles.

4. A process according to claim 1, wherein 0.2–2.0 parts by weight of the copolymer as solid matters and 0.2–4.0 parts by weight of the calcium hydroxide are added to 100 parts by weight of the refractory particles.

5. A process for preparing a mold by hardening molding materials by $CO_2$ gas, which comprises mixing refractory particles with a binder material comprising a caustic alkali-neutralized product of at least one copolymer selected from the group consisting of α-olefin-maleic anhydride copolymer, styrene-maleic anhydride copolymer, and methylvinyl ether-maleic anhydride copolymer, calcium hydroxide, and polyvinyl alcohol, thereby preparing molding materials, filling the molding materials around a pattern, and blowing $CO_2$ gas into the molding materials, thereby hardening the molding materials.

6. A process according to claim 5, wherein not more than 2 parts by weight of the polyvinyl alcohol is added to 100 parts by weight of the refractory particles.

7. A process for preparing a mold by hardening molding materials by $CO_2$ gas, which comprises mixing refractory particles with a binder material comprising a caustic alkali-neutralized product of at least one copolymer selected from the group consisting of α-olefin-maleic anhydride copolymer, styrene-maleic anhydride copolymer, and methylvinyl ether-maleic anhydride copolymer, calcium hydroxide, and at least one member selected from the group consisting of calcium oxide and hydroxides of zinc, aluminum, barium, magnesium and iron, thereby preparing molding materials, filling the molding materials around a pattern, and blowing $CO_2$ gas into the molding materials, thereby hardening the molding materials.

8. A process for preparing a mold by hardening molding materials by $CO_2$ gas, which comprises mixing refractory particles with a binder material comprising a caustic alkali-neutralized product of at least one copolymer selected from the group consisting of α-olefin-maleic anhydride copolymer, styrene-maleic anhydride copolymer, and methylvinyl ether-maleic anhydride copolymer, calcium hydroxide, and SBR styrene-butadiene rubber latex, thereby preparing molding materials, filling the molding materials around a pattern, and blowing $CO_2$ gas into the molding materials, thereby hardening the molding materials.

* * * * *